United States Patent [19]

Anthony

[11] 4,283,107

[45] Aug. 11, 1981

[54] LAMPHOLDER HAVING TERMINALS OF THE INSULATION-DISPLAYING TYPE

[75] Inventor: Walter Anthony, Pine Beach, N.J.

[73] Assignee: GTE Sylvania Wiring Devices Inc., Trenton, N.J.

[21] Appl. No.: 63,215

[22] Filed: Aug. 2, 1979

[51] Int. Cl.[3] ..... H01R 11/20; H01R 13/639

[52] U.S. Cl. ..... 339/147 R; 339/97 L; 339/176 L

[58] Field of Search ..... 339/96, 95 D, 97 R, 339/97 P, 97 L, 98, 99 R, 197 R, 176 L; 315/198, 313, 317; 362/95

[56] References Cited

U.S. PATENT DOCUMENTS

| | | | |
|---|---|---|---|
| 2,728,059 | 12/1955 | Lagin | 339/97 L |
| 2,769,154 | 10/1956 | Greenbaum | 339/99 R |
| 3,117,829 | 1/1964 | Leach | 339/97 P |
| 4,141,617 | 2/1979 | Freeman | 339/97 L |

*Primary Examiner*—Eugene F. Desmond
*Attorney, Agent, or Firm*—William R. McClellan

[57] ABSTRACT

A lampholder, of the type intended to support and supply electrical current to an incandescent lamp bulb, has terminals movable from normally retracted positions to positions in which they displace the insulation sheath of a current-supplying conductor wire, so as to make electrical contact with the conductive element of the wire. On movement of the insulation-displacing terminals to positions in which they displace the wire insulation and make contact with the wire conductors, the terminals are latched automtically against retrograde movement. Means is provided for facilitating the wiring of the lampholder to supply current either to single-filament or two-filament lamps, whether in association with a single lamp of the single-filament or double filament type, or alternatively in parallel with one or more additional single or double filament lamps. The lampholder can if desired be made as an interior for use in shells already standard in the industry, and in addition, is adapted to be made either with switches (for example, rotary turn knob switches) or alternatively, as a keyless device.

15 Claims, 25 Drawing Figures

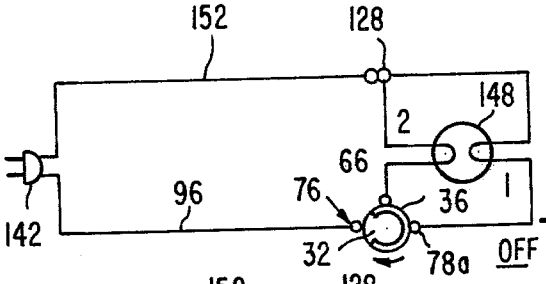
Fig. 15a
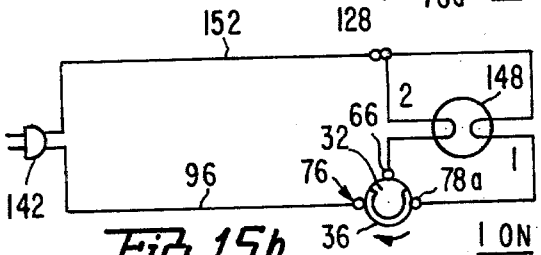
Fig. 15b
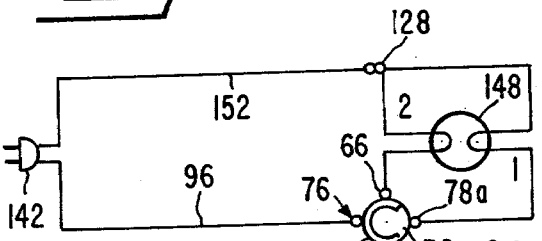
Fig. 15c
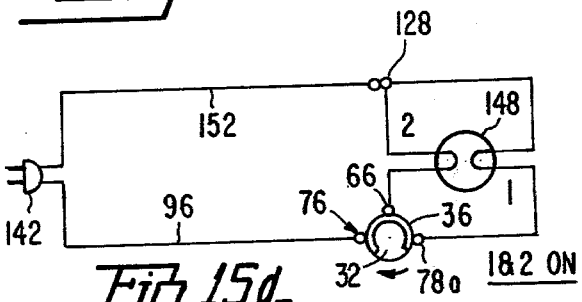
Fig. 15d
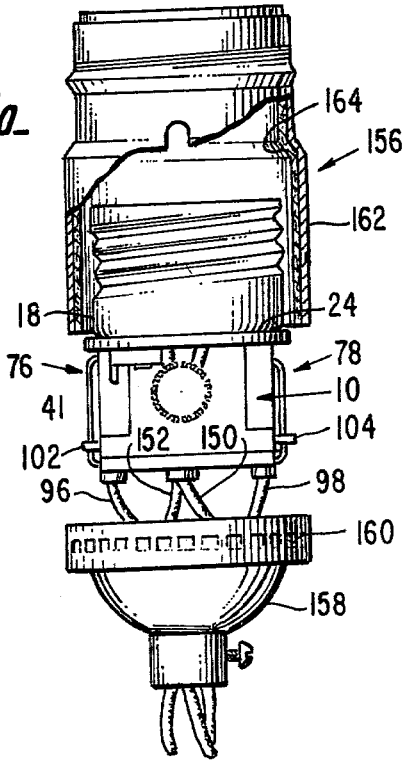
Fig. 16
Fig. 17
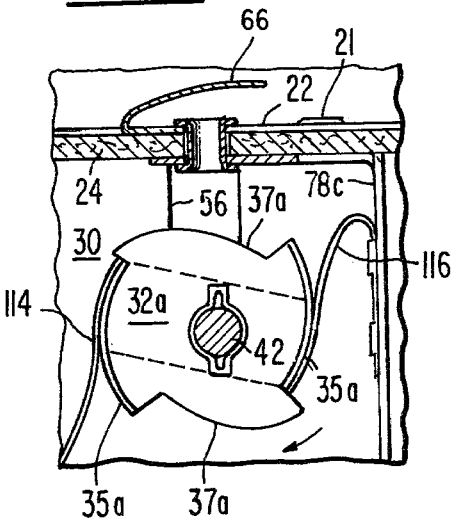
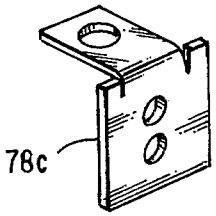
Fig. 18

LAMPHOLDER HAVING TERMINALS OF THE INSULATION-DISPLAYING TYPE

BACKGROUND OF THE INVENTION

1. Field Of The Invention

The present invention relates to the art of incandescent lampholder construction generally. In a more particular sense, the invention relates to the type of lampholder for incandescent lamps, having terminals to which current-carrying wires are separably connectable. In the present invention the terminals are of the type wherein insulation-displacing blades are extendible in paths disposed transversely of the lengths of the wire, for the purpose of displacing the wire insulation and making, as a consequence, direct contact with the metallic conductors of the wires. The invention is applicable both to lampholders or incandescent lamp sockets of the type having built-in switches, and sockets or lampholders known in the industry as lampholders of the keyless, that is, switchless type.

2. Description Of The Prior Art

Heretofore, lampholders, especially interiors, have most usually been provided with screw terminals. Such terminals, while quite efficient as a general proposition, tend to require excessive time in the connection of current-carrying wires to the lampholder. This is a matter of great significance in the lamp industry, since lampholders of the type disclosed in the present application are most usually mounted in table lamps, floor lamps, bridge lamps, and vanity lamps and indeed, in a seemingly limitless variety of appliances. The lampholders are normally sold in quantity to manufacturers of appliances of this type, for assembly into the finished product, and obviously in view of continually increasing costs of assembly labor, it is important to seek means whereby speeding up of the assembly of the wires with the lampholders can be achieved. Heretofore, little progress has been made in solving this problem, so far as lampholders of the so-called Edison-base type are concerned. In some instances, lampholders used for Christmas trees have utilized some types of insulation-piercing terminals for connecting a substantial number of said lampholders in parallel. However, when one seeks to embody so-called "quick-wire" terminals in Edison-base lampholders, many problems arise, since lampholders of this type must meet very stringent requirements so far as industry and Underwriters Labooratories standards are concerned. For example, typically lampholders of the type here under consideration carry ratings of 250 watts to 660 watts, 250 volts and must successfully pass exacting tests so far as voltage breakdown, heating, or the like are concerned.

So far as is known, the prior art has not as yet successfully provided a lampholder that can utilize and does utilize insulation-displacing terminals that will pass the exacting tests required for such lampholders, will be fully safe in that said terminals will be assured against movement out of their operative conductor-engaging postions, and will be adapted for swift and easy assembly with conductors without requirement of stripping the insulation therefrom - a practice which, it may be noted, is exceedingly expensive and time-consuming but which is absolutely necessary whenever terminals of the screw type are used.

For example, Underwriters Laboratories now requires that when the lampholder is an interior, the stripped ends of the conductors must be tinned to prevent stray wire ends from contacting a metal cap or shell in which the interior is mounted. This is a costly requirement for a portable lamp manufacturer, obviated by the invention which eliminates stripping and offers an extremely safe termination means.

SUMMARY OF THE INVENTION

Summarized briefly, the present invention comprises a lampholder which has a plurality of insulation-displacing terminals which in the present instance are anchored in the body of the lampholder, and normally project laterally outwardly therefrom. The terminals have at their distal ends single or double blades adapted for displacing insulation from unstripped wires extended into wireways of the lampholder body, the arrangement being such as to permit the terminals to be swung inwardly toward the body, whereby the blades move across the wireways and displace the insulation from the conductors. In this way, electrical contact is made between the current-carrying elements of the wires, and the terminals. The terminals are in turn connected to various components of the lampholder interior, as for example the center contact of the interior that normally engages the center contact of an incandescent lamp base, and the screw shell, into which the lamp base is threaded when mounted in the lampholder.

The construction has been designed, further, to permit utilization of the invention, with minimum modification of the component parts thereof, in lampholders that are either of the switching or alternatively, of the keyless, type. When a lampholder of the switch-provided type is being assembled, the swingable terminals are secured to the appropriate contacts of the switching mechanism. When, on the other hand, a lampholder of the keyless type is being assembled, the terminals can be modified at their anchored ends, for the purpose of direct attachment to such components as the center contact or the screw shell of the lampholder.

The body of the lampholder is so designed as to provide latching elements, which releasably engage the insulation-displacing elements of the terminals when said elements are moved into operative, current-carrying position across the wireways. The latching elements are so formed as to resiliently, yieldably move outwardly to permit the passage of the insulation-displacing members as said members move to their operative positions across the wireways. Then, the latching means, by reason of the inherent resiliency thereof, move back into position to prevent the terminals from backing out of the wireways.

The construction further permits the use of terminals modified slightly in respect to one another, to permit the lampholder to serve as a means for supplying current to so-called three-way lamp bulbs, that is, lamp bulbs having two filaments which can be separately or jointly energized to provide three levels of illumination. The lampholder further is adapted to permit it to be wired in parallel with other lampholders, whereby to permit a single lampholder having a switching means, to be used for controlling the illumination of a plurality of incandescent lamp bulbs. In this respect, the lampholder is thus adapted, though having the so-called "quick-wire" means described, to serve all the functions of lampholders of the screw terminal type. This is important, because a lampholder that is not capable of discharging all of these already recognized and required functions, is unacceptable to the lamp industry, in which lamps must regularly be assembled to meet a wide variety of customer requirements.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

FIGS. 15*a*, 15*b*, 15*c*, and 15*d* are views in the form of circuit diagrams, illustrating the lampholder as it appears when controlling a two-filament incandescent lamp, the views showing the circuit in successively following positions of the switch mechanism;

FIG. 16 is an exploded view, partly in side elevation and partly in section, showing the lampholder as it appears when being mounted in a conventional metal shell socket;

FIG. 17 is a fragmentary section similar to FIG. 3 showing a modification used for a single, switch-controlled, single filament lamp; and FIG. 18 shows a modified terminal used in the FIG. 17 circuit configuration.

DETAILED DESCRIPTION OF THE PREFERRED EMBODIMENTS

Referring to FIGS. 1–6, wherein the lampholder interior is of the type incorporating a rotary switch mechanism and is assembled for the purpose of controlling the illumination of a plurality of incandescent lamps (not shown), an electrically insulative body generally designated 10 may be molded as a single piece but for convenience and economy of manufacture is illustrated as comprising a first body portion 12 fixedly secured to a second body portion 14 at their interface 16.

In the illustrated example, the lampholder is in the form of a socket interior insertable in a cap and shell (see FIG. 16). However, this is merely one type of lampholder in which the invention can be embodied. The terms "lampholder", "socket", or "interior" will accordingly be understood as referring to any type of device for supporting and supplying current to an incandescent lamp.

Figure 11:
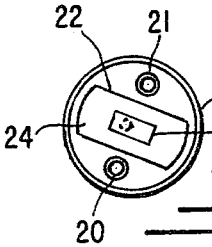
FIG. 11 is a view, on a reduced scale, of the lampholder as seen when looking into the screw shell.

A conventional, electrically conductive, metallic, one-piece screw shell 18, having threads for receiving an incandescent lamp base (not shown) is secured by eyelets 20, 21, passing through inwardly directed lips 22, of the screw shell (see FIG. 11) to the body portion 12. Separating the screw shell base from the body portion 12 is a circular, flat, electrically insulative fiber disc 24 supported (see FIG. 2) upon diametrically opposed, flat ledges 26, 28 apertured for receiving the eyelets 20, 21 respectively.

The first body portion 12 is formed with a hollow interior, defining in the body 10 a central cavity 30 which, in the lampholder embodiment incorporating a switch mechanism, receives a rotor 32 (FIGS. 3 and 4) having a plurality of steps 34 defining a corresponding number of switch contact faces 35, selected ones of which are covered by a stepped, wraparound, electrically conductive contact 36.

A center opening 38 of the body of the rotor (the rotor body would be formed of fiber or of molded plastic) receives a mandrel 40, of elongated formation (FIG. 2), extending out of the body and having at its outer end a turn knob 41 secured to the mandrel for rotation therewith. Intermediate its ends, the mandrel is formed with diametrically opposed ribs 42 swaged out of the material of the mandrel and engaging in diametrically opposite slots 44 of the rotor communicating with opening 38 thereof. Thus, on rotation of the turn knob, the rotor is rotated within the body, in the direction shown by the arrow in FIG. 3.

Figure 1:
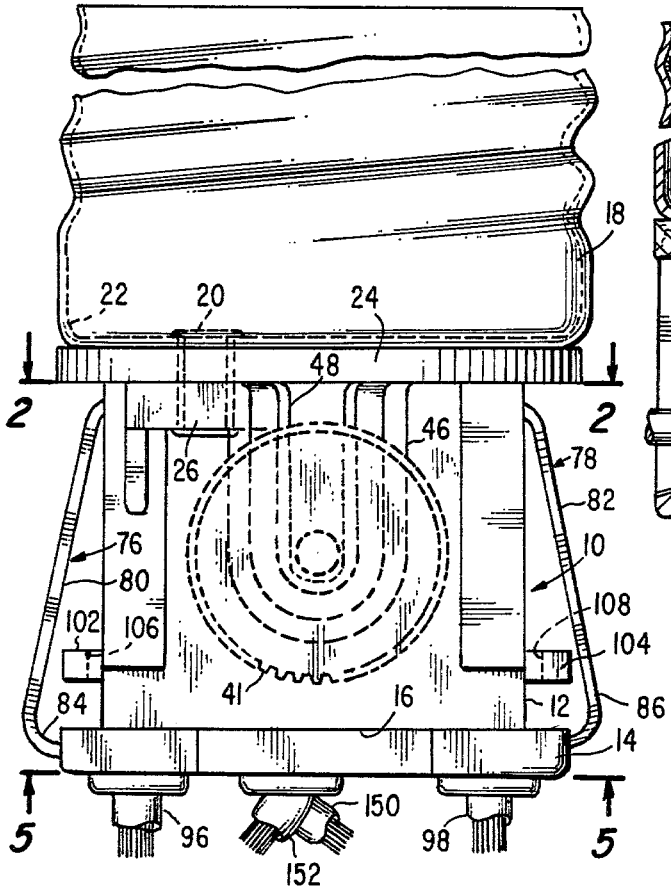
FIG. 1 is a side elevational view of a lampholder formed according to the present invention, a portion being broken away, in association with a plurality of insulated wires that extend into the wireways.
Figure 4:
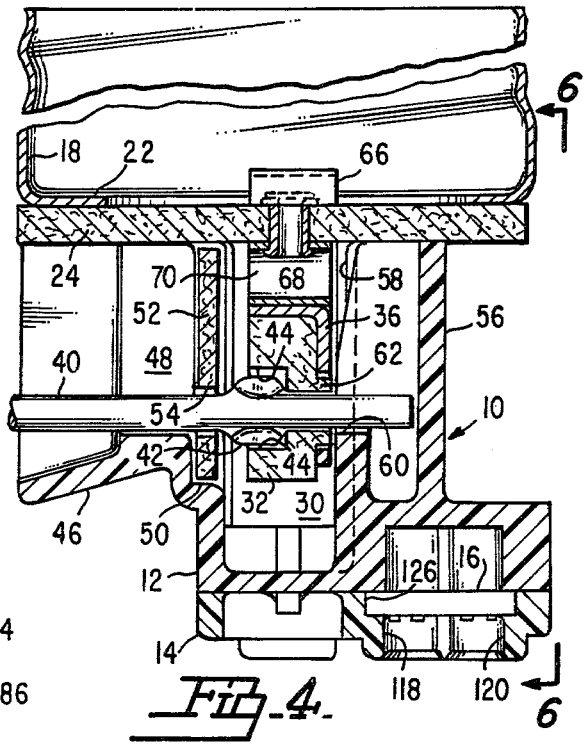
FIG. 4 is a sectional view through the lampholder substantially on line 4—4 of FIG. 3.
Figure 2:
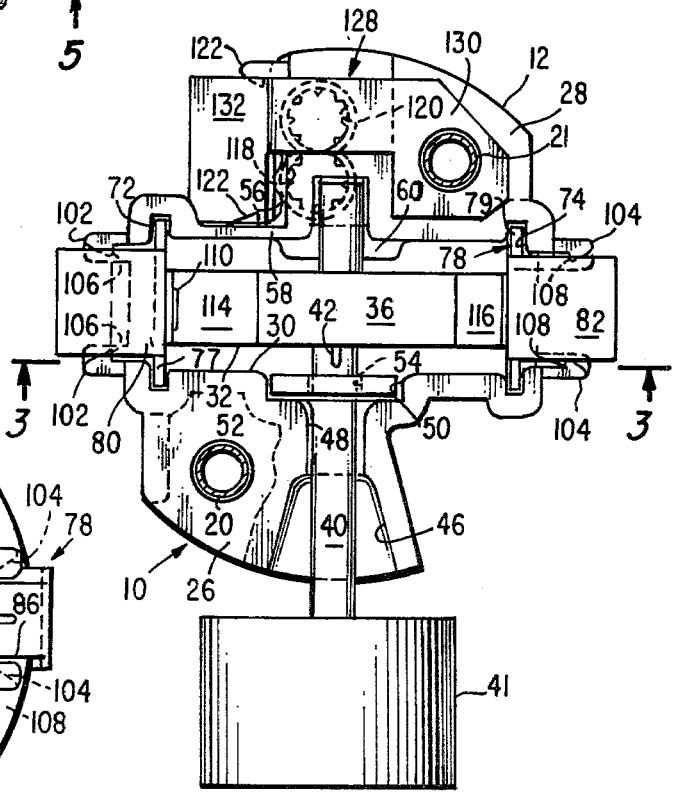
FIG. 2 is a sectional view taken across the lampholder at the upper end of the lampholder body, substantially on line 2—2 of FIG. 1.

As shown in FIGS. 1 and 2, a bearing slot 48 is formed in one side wall of the body portion 12, and is adapted to support one end portion of the mandrel for rotation. Bearing slot 48 is formed in a flared, U-shaped bearing portion 46 molded upon the side wall of the body portion 12 (see FIG. 4). At the inner end of the flared bearing portion 46, the inner surface of the side wall of the body portion 12 is molded with a shallow recess 50, receiving a fiber retainer 52 having a slot 54 adapted to receive the mandrel. The fiber is disposed in the path of the ribs 42, to engage the mandrel from being moved laterally outwardly of the body.

In the opposite side wall of the body portion 12 there is formed an outwardly directed, hollow offset 56 (see FIGS. 2 and 4) adapted to receive the inner end of the mandrel. Within the offset 56 there is provided a wall 58, integral with a bearing surface 60 supporting the mandrel for rotational movement in cooperation with the bearing defined by slot 48. Adjacent bearing surface 60 the rotor is formed with a collar 62, providing insulation between the mandrel and the rotor contact 36.

Figure 3:
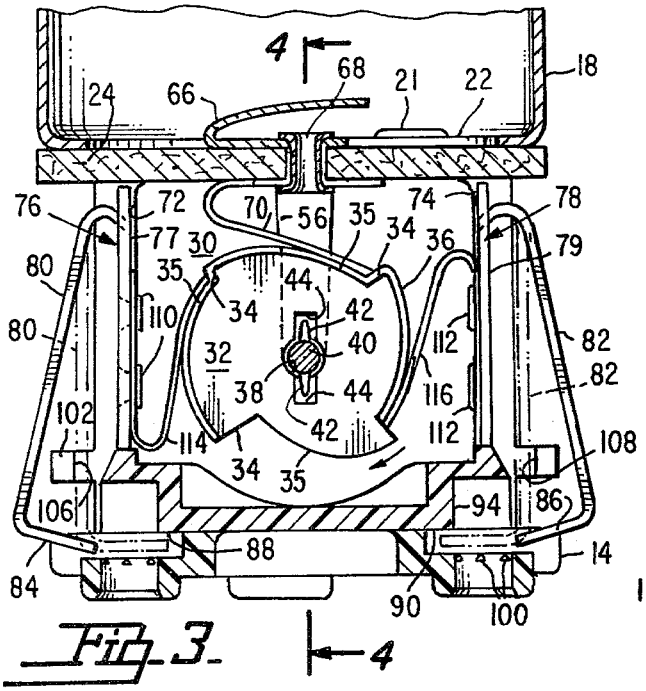
FIG. 3 is a sectional view through the lampholder substantially on line 3—3 of FIG. 2.
Figure 6:
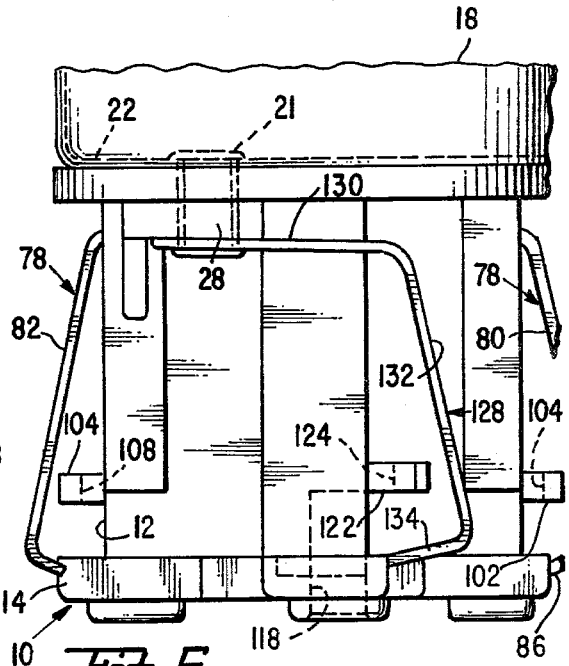
FIG. 6 is a side elevational view of the lampholder as seen from the line 6—6 of FIG. 4, a portion being shown in section.

Referring to FIG. 3, a conventional center contact 66, of the folded spring type, is adapted to be engaged by the center contact of an incandescent lamp base, when the lamp is threaded into the screw shell. Center contact 66 is secured by eyelet 68 in position upon the fiber 24, in spaced relation to the base portion of the screw shell.

Eyelet 68 and the center contact 66 are, as will be understood, of electrically conductive metal material, and eyelet 68 secures the center contact to the proximal end of a folded spring contact 70 of the switch mechanism, disposed within the cavity 30 of body 10.

Formed in opposite walls of the body portion 12 (see FIGS. 2 and 3) are mounting slots 72, 74 adapted to receive insulation-displacing terminals 76, 78 respectively. The terminals 76, 78 are of identical formation but oppositely arranged as shown in FIG. 3, and accordingly, it will be understood that the showing of the terminal 76 in FIG. 8 will be considered as sufficing for an illustration of the terminal 78.

Terminals 76, 78 are formed of electrically conductive, metal material, for example a low temper brass alloy, and as will be noted, comprise elongated tongues 80, 82 respectively disposed exteriorly of the body 10, and formed integrally with flat mounting plates 77, 79 the opposite side edges of which are slidably received within the slots 72, 74.

At their distal ends, the tongues 80, 82 are respectively formed with inwardly projecting, angular extensions, comprising insulation-displacing blades 84, 86 respectively. The blades are disposed approximately at right angles to the length of their associated spring tongues 80, 82 as best shown in FIG. 3, and as will be noted from FIG. 8, the blades are slotted as at 87, to receive the metal conductor of insulated wires, the insulation of which is displaced by the blade portions disposed at opposite sides of the slots 87.

So far as the insulation-displacing blades of the terminals are concerned, it may be noted that these are known in the prior art, in and of themselves, and may be of the exact form as shown, by way of example, in U.S. patent to Levin et al, U.S. Pat. No. 3,012,219.

The terminals 76, 78 are of the one-wire, single displacement type, that is to say, each of these terminals has but one slot 87, and is thus adapted to displace the insulation and make electrical connection with only one wire.

Figure 5:
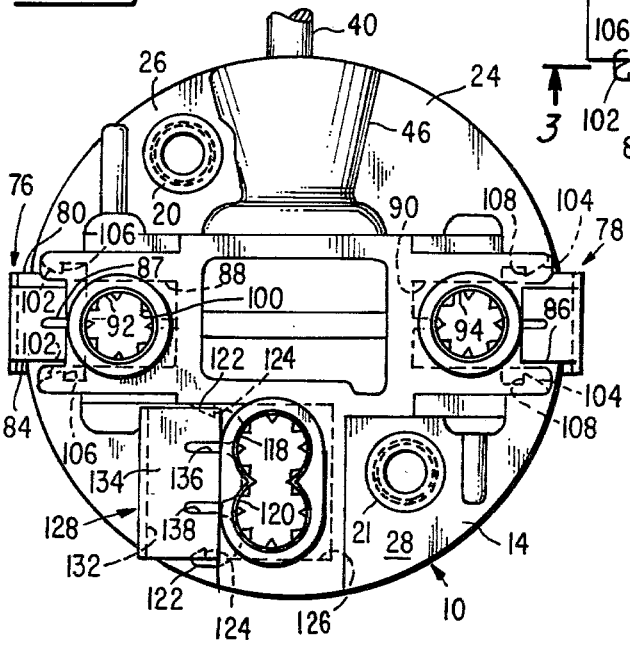
FIG. 5 is a bottom plan view of the lampholder as seen from the line 5—5 of FIG. 1.

Referring to FIGS. 3 and 5, it is here seen that body portion 14 is formed with a plurality of wireways. Thus, the body portion is formed with diametrically opposite wireways 92, 94, which are continued into the body portion 12, and which open at the end of the body 10 remote from the screw shell, for the purpose of receiving insulated wires that are to be electrically connected to the lampholder. Wireways 92, 94, thus are adapted to receive wires 96, 98 (see FIG. 1). The wires are not stripped prior to insertion in the wireways, and are simply inserted until they abut against the inner ends of the wireways shown in FIG. 3. When so inserted, they are held against accidentally dropping out of the wireways prior to displacement of their insulation by the blades 84, 86, through the medium of a circumferential series of inwardly projecting teeth 100 molded in the wall of each wireway as best shown in FIG. 3, and also as shown to good advantage in FIG. 5. Each wireway of the lampholder is provided with a similar series of circumferential teeth, it being understood that the teeth are so angled as to engage lightly but firmly in the surface of the sheath of insulation of each wire, to temporarily hold the wire in place until the tongues of the terminals 76, 78 are swung inwardly from the full line position shown in FIG. 3. When the terminals are swung inwardly, they move to the chain-dotted positions thereof shown in FIG. 3, and it is thus seen that they move from positions in which the blades 84, 86 are clear of the wireways, to positions in which said blades extend fully across the wireways, and displace the insulation from the wires, while firmly holding the wires in place and making full electrical contact therewith.

When the tongues are swung inwardly from their full to their dotted line positions shown in FIG. 3, they move past latching projections 102, 104 respectively molded upon the outer surface of the body portion 12. The latching projections, as shown in FIGS. 2 and 5, are formed with confronting, triangular teeth, which define surfaces that yield to passage of the tongues as the tongues swing inwardly, after which the latching projections swing back to present abutment surfaces 106, 108 to prevent retrograde movement of the spring tongues 80, 82 respectively. The tongues are thus locked in the dotted line positions shown in FIG. 3, with the insulation fully displaced from the wires, and the blades 84, 86 in full electrical contact with the conductive cores of the wires 96, 98 respectively.

Figure 8:
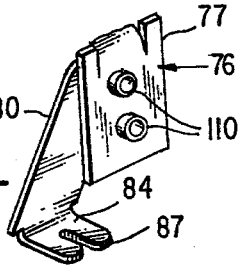
FIG. 8 is a perspective view of one of the single-wire insulation-displacing terminals per se.

Referring to FIGS. 3 and 8, it may here be noted that the mounting plates 77, 79 of the terminals are formed with swaged bosses 110, 112, which enter openings formed in folded spring contacts 114, 116 of the switch mechanism (see FIG. 3), after which the bosses are swaged over onto the proximal end portions of the folded contacts, so as to fixedly locate the respective contacts 114, 116 to the terminals 76, 78 respectively, in electrical engagement therewith.

The contacts might if desired simply be left in face-to-face engagement with the terminals rather than being swaged thereto, this being an alternative known arrangement used by some manufacturers for electrically engaging the spring contacts with associated terminal plates.

Referring now to FIG. 3, it may be noted that in one position of the rotor 32, the contact 36 thereof is in engagement with the distal ends of all the switch contacts 70, 114,116. The rotor turns clockwise viewing the same as in FIG. 3, and in the next position, the surface 35 would be engaged by the contact 114. As will presently appear, the contact 114 is connected to the "hot" side of an electrical circuit, in a typical installation, so in this position the switch would be off. In the next following position to which the rotor is indexed, the rotor contact provides an electrical bridging connection between contacts 114, 116. Then, in the next position, contacts 114, 70 would be bridged and finally, in yet another position the rotor returns to the FIG. 3 position in which there is a bridging electrical engagement across all of the spring contacts.

Referring now to FIG. 5, the body is also formed with side-by-side wireways 118, 120. Interiorly, these are also provided with retaining teeth similar to those shown at 100. Wireways 118, 120 are in close proximity to confronting latching positions 122, 122 having latching teeth or abutments 124, 124. The latching projections are disposed at opposite sides of a guideway 126 that lies transversely of the wireways 118, 120 to accommodate insulation-displacing blade means of a two-wire insulation-displacement terminal generally designated 128 and shown to particular advantage in FIGS. 2, 6, and 9. At this point, it may be noted that the terminals 76, 78 are also provided with guideways, which have been designated at 88, 90, adapted to receive the blades 84, 86 respectively, in the same way that the guideway 126 receives the blade of terminal 128.

Terminal 128 is secured to the screw shell, thus comprising what is commonly termed in the art as a neutral terminal of the lampholder, since the screw shell is normally so termed. It is well understood, in this regard, that if a plug of a cord extending from the table lamp or other appliance in which the lamp socket interior is installed, happens to be formed with unpolarized blades, then at times the screw shell may be "hot" and the center contact may be neutral. For the purposes of the present application, however, the screw shell will be termed the "neutral" side of the circuit and the center contact will be arbitrarily designated as the "hot" side.

Figure 9:
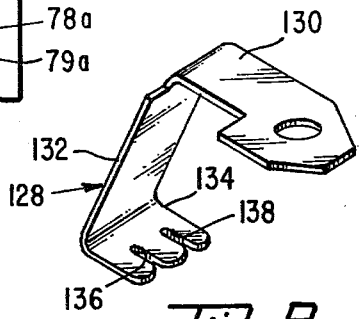
FIG. 9 is a perspective view of a two-wire insulation-displacing terminal.

The two wire terminal 128 is seen from FIG. 9 as including, at its proximal end, a flat mounting plate 130. Eyelet 21 passes through the aperture of the plate 130, and secures the plate 130 to body 10, fiber 24 and the base of the screw shell to provide a good electrical connection therebetween.

Integral with the plate 130 is a tongue 132 of the terminal 128, merging into an inwardly directed insulation-displacing blade 134 which is identical to the blades 84, 86 except for having parallel, spaced slots 136, 138. Thus, terminal 128 is of the two-wire type, displacing insulation from two wires simultaneously when the wires are positioned within the wireways 118, 120.

Figure 10:
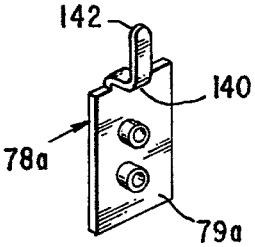
FIG. 10 is a perspective view of a single-wire insulation-displacing terminal, modified for supplying current to a lamp of the two-filament type.

The terminals so far described would be of the type used in assembling a lampholder adapted to receive the ordinary, single filament incandescent lamp. Many incandescent lamps, however, are of the so-called "three-way" type, that is, they provide three levels of illumination and have two separately energizable lamp filaments. When the lampholder is to be assembled for the purpose of receiving an incandescent lamp of this type, instead of the terminal 78 there would be utilized a terminal formed as shown in FIG. 10, and generally designated 78*a*. This terminal is connectable to contact 116, and has a flat mounting plate 79*a* adapted to be received in the mounting slots 74.

Figure 7:
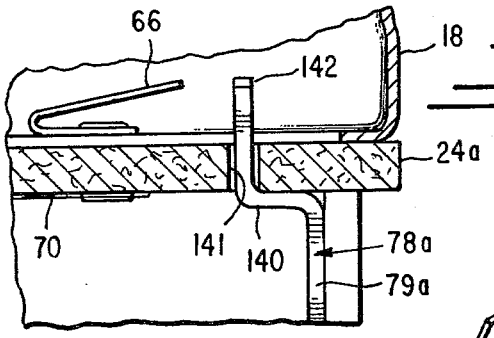
FIG. 7 is a fragmentary sectional view on the same cutting plane as FIG. 3, showing a modified terminal used when assembling a lampholder of the so-called "three-way" type designed for controlling the illumination of two-filament lamp bulbs.

Terminal 78*a* has, integral with the plate 79*a*, an angular extension 140 (see also FIG. 7) which extends through a slot 141 of a modified separator 24*a*, into the screw shell interior, in spaced relation both to the screw shell and the center contact. This provides an intermediate contact 142, adapted to engage an annular contact ring provided on the base of a conventional two-filament lamp.

It is appropriate now to consider the operational characteristics of a lampholder formed according to the present invention.

In use, a lampholder assembled as shown in FIGS. 1 through 6, that is, a lampholder adapted for receiving a conventional single-filament incandescent lamp bulb, would be used for controlling a plurality of incandescent lamps, in the manner shown in FIGS. 14*a*, 14*b*, 14*c*, and 14*d*. Such a lampholder would have the confronting, opposite but identical one-wire terminals 76, 78, and would also have the two-wire terminal 128, all as shown in FIGS. 1–6. A lampholder of this type can be mounted in association with a keyless socket having a conventional, single-filament incandescent lamp 144, the filament of which has been identified in FIGS. 14*a* through 14*d* as "1". An incandescent lamp 146, also of the single-filament type, is mounted in the screw shell 18, and has a filament designated for purposes of this description as "2".

The circuit illustrated in FIGS. 14*a* through 14*d* is completely conventional, and is widely used in the industry, utilizing lampholders having screw terminals or having wires soldered into the socket or otherwise permanently electrically connected. The circuit has been illustrated, however, in this application for the purpose of showing how the lampholder constituting the present invention is assembled for use in circuits of this type.

In any event, the circuit would be connected to a source of power through the provision of a conventional electrical plug 148, provided on the end of a two-wire conductor, one of the wires comprising the so called "hot" wire 96 extending through wireway 92 and electrically connected to terminal 76.

Figure 14A:
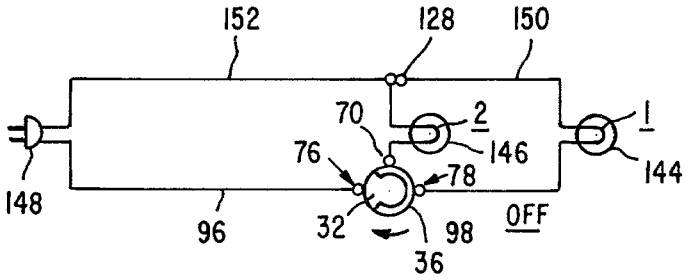
FIGS. 14*a*, 14*b*, 14*c*, and 14*d* are circuit diagrams showing a lampholder according to the present invention, as it appears when used for the purpose of controlling illumination of two single-filament incandescent lamps, the circuit being shown in different, successively following conditions according to the position of the switch mechanism of the lampholder.

Referring to FIG. 14*a*, in which the rotor has been turned to the "off" position, it will be seen that the circuit is open from the source of electric power, since terminal 76 is electrically disconnected from any of the other terminals or contacts, by reason of the fact that spring contact 114 would be out of engagement with the three-sided bridging contact 36.

Figure 14B:
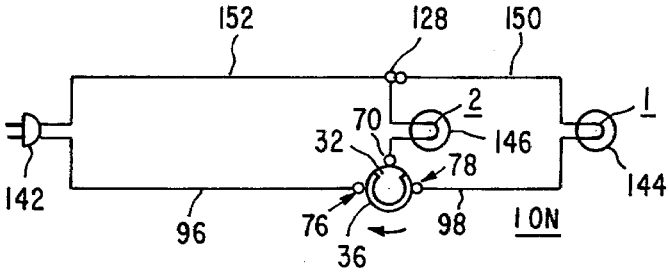

Referring to FIG. 14*b*, the rotor is turned clockwise one step, and now the stepped contact is arranged to bridge the spring contacts 114, 116, providing a connection between terminals 76, 78. Current flows through wire 96, and through the bridged terminals, so as to leave the lampholder through the wire 98, which is connected to one terminal of a remotely located keyless socket carrying the incandescent lamp 144. From the other side of the lamp 144, the current flows through a wire 150 connected to the other terminal of the keyless socket, to return to the disclosed lampholder, the conductor 150 being electrically connected to the two-wire neutral terminal 128. Wire 150 extends into one of the wireways 118, 120, and hence is electrically connected to the terminal 128. Also electrically connected to the terminal 128, by extension into the companion wireway, is a wire 152, comprising the other wire of the electric cord extending to plug 142.

Thus, in FIG. 14*b*, incandescent lamp 144 is on.

Figure 14C:
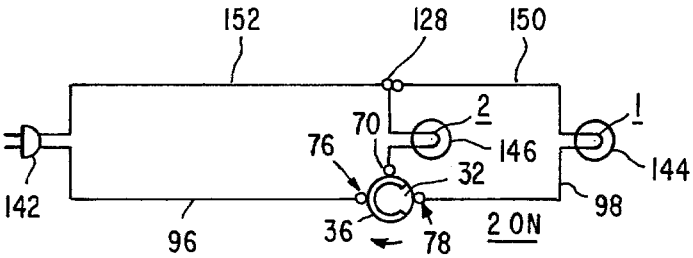

In the next position to which the rotor is advanced, illustrated in FIG. 14*c*, the contact 36 bridges terminal 76 and spring contact 70, so that current is supplied to the center contact of the lamp 146 engaged in screw shell 18 of the disclosed lampholder. As a result, lamp 146 is illuminated while lamp 144 is de-energized, with the current returning to the source through the screw shell, terminal 128, and wire 152.

Figure 14D:
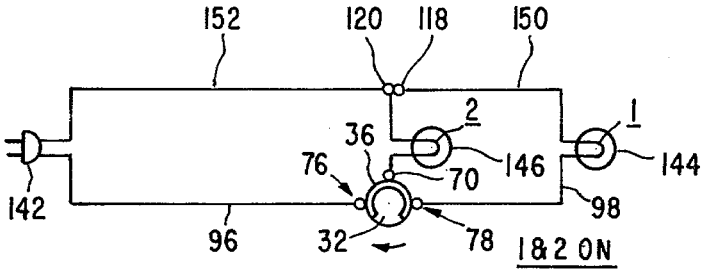

In FIG. 14*d*, the circuit configuration is "1 and 2 on", that is, both lamps 144 and 146 are illuminated, with the rotor now in the position in which rotor contact 36 bridges all of the spring contacts, providing an electrical connection between terminals 76, 78, and the center contact of lamp 146. As a result, lamp 144 is energized by current flowing in the path described with respect to FIG. 14*b*, and lamp 146 is energized in the manner described with reference to 14*c*.

Referring to FIGS. 15*a* through 15*d*, the disclosed lampholder is here shown in association with a two-filament incandescent lamp, engaged in the screw shell 18. In this arrangement, instead of the terminal 78 there would be used the terminal 78a shown in FIGS. 7 and 10. Also used is the terminal 128. However, only a single wire is engaged with the terminal 128, and no wire is connected to the terminal 78a. In other words, only two wires extend to the lampholder, these being the wires 96, 152 connected to plug 142 to provide a connection to opposite sides of a source of electric power.

In this arrangement, when the rotor is in the FIG. 15a position, the lamp is off completely, because the "hot" terminal 76 is disconnected from the remaining components of the lampholder, electrically speaking.

In FIG. 15b the rotor has been turned one step, and contacts 76, 78a are bridged. As a result, current flows through the intermediate terminal of the incandescent lamp, so that filament "1" thereof is energized, to provide a first level of illumination of the lamp, it being understood that filament 1 is connected to the screw shell base of the incandescent lamp, so that current returns through the terminal 128 and the wire 152 to the source of power.

In FIG. 15c, the other filament "2" of the incandescent lamp is energized, by rotation of the rotor one or more steps to bridge "hot" terminal 76 and the center contact 66 electrically. The center contact is connected to one side of the other filament "2" of the incandescent lamp, said filament "2" also being connected to the threaded shell of the lamp base so that current again returns through terminal 128 to the source of power. This provides a second level of illumination of the lamp.

In FIG. 15d, both filaments are energized to provide a third level of illumination. In this position, current flows from the "hot" terminal both to the center contact 66 and to the intermediate contact 78a. Both filaments are energized, with current returning through the terminal 128.

The lampholder can also be assembled as a single lampholder, in the sense that it may simply be utilized with an incandescent lamp of the single filament type, and arranged to control the illumination only of that one lamp. In these circumstances, the lampholder would be assembled with the terminals 76 and 128 one of which would be connected to "hot" wire 96 and the other to the neutral wire 152 of the lamp cord. Thus, in FIG. 17 a terminal 78c of right-angular form (see FIG. 18) is electrically connected to contact 116, in the same manner as contact 116 is connected to terminal 78. Terminal 78c is connected to contact 66, and a rotor 32a is used, having a two-sided rotor contact formed with opposed conductive faces 35a alternating with non-conductive faces 37a. In this "on" position current passes through terminal 76, rotor 35a and terminal 78c to the center contact, through the lamp filament and thence through the screw shell 18 and terminal 128. In the "off" position the contacts engage the rotor faces 37a breaking both sides of the circuit.

Figure 12:
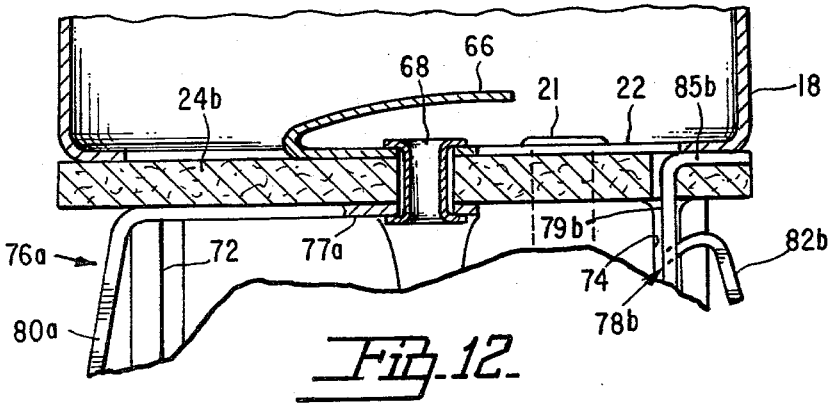
FIG. 12 is a fragmentary sectional view, on the same cutting plane as FIG. 3, showing a modification wherein the terminals are adapted for use in lampholders either of the keyless type, or of the switched, single-circuit type.
Figure 13A:
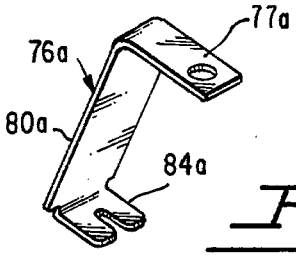
FIGS. 13*a* and 13*b* are perspective views of the modified insulation-displacing terminals used for assembly in keyless or switched single-circuit lampholders of the type shown in FIG. 12.
Figure 13B:
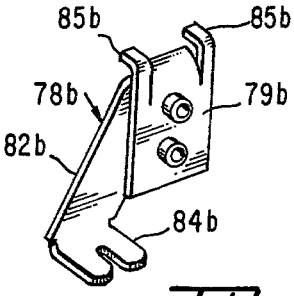

The lampholder can also be assembled as a keyless socket. In these circumstances, two terminals only, formed as shown in FIGS. 13a and 13b would be mounted as shown in FIG. 12. The "hot" terminal has been designated 76a, and is identical to terminal 76 except for having a mounting plate 77a which is not received in the guide slots 72, but rather, is secured by eyelet 68 in electrical engagement with center contact 66. The terminal would have a spring tongue 80a and insulation-displacing blade 84a.

In this arrangement, the terminal 76a would be used in place of terminal 76. Also used is a modified terminal 78b having a right-angular extension 85b on its mounting plate 79b constituting an electrical contact engaging the base of the screw shell 18. The entire switch mechanism, comprising the rotor, mandrel, and the spring contacts 70, 114, 116 would also be omitted. A wire would extend into wireway 92, and one wire would extend into wireway 94. These would comprise the "hot" and neutral sides, respectively, of a single circuit. The socket would thus be of the keyless type, with illumination controlled, if desired, by a remotely located switch mechanism.

In all forms of the invention, the lampholder is usable in the same circuit configuration, and with the same kinds of conventional incandescent lamps, as are used in association with conventional lampholders of the screw terminal type. The lampholder of the present invention, however, has the distinct advantage in that it permits wires to be connected without stripping the ends thereof, and further permits the wires to be connected to the lampholder without the necessity of forming loops on the ends of the wires, and securing them by means of binding head screws. The elimination of the practice of "tinning" stripped ends of conductors (presently a UL requirement) further provides distinct economies, particularly with respect to assembly labor used by lamp manufacturers.

The adaptability of the lampholder for substitution for conventional lampholders is further illustrated in FIG. 16, wherein the lampholder is shown in association with a conventional metal, two-part shell 156. A shell of this type includes a base 158 of cup shape, having nibs 160 adapted to releasably engage in mating recesses of a cylindrical sleeve 162, having a paper liner 164. The lampholder of the present invention is first assembled with the wires, in the manner previously described herein, with the terminals swingably moved to their inner positions and locked by means of the latching elements 102, 104, 122 respectively. The sleeve 162 is then engaged with the base 158, and the device is ready for use.

In FIG. 16, thus the lampholder is in the form of a socket interior. This is one—but not the only one—of the various forms that the lampholder can take.

It is believed to be within the spirit of the invention (when used as an interior) to permit the sleeve 162 to itself serve as a means engaging the inwardly swung terminals 76, 78, 128 against accidental retrograde movement to their outer positions. In these circumstances the latching projections may conceivably be omitted, that is, after the terminals have been moved inwardly and the lampholder has been assembled with the screw shell, the liner 164 would be disposed in juxtaposition to the inwardly moved terminals after said terminals have been moved to positions in which the insulation has been displaced from the wires and the electrical contact has been made with the cores of the wires. With the metal shell assembled with the lampholder interior, the terminals 76, 78 are prevented from moving outwardly from their inner positions, due to the presence of the lined sleeve 162, which would prevent the outward movement of the tongues. It is preferred, however, to provide the latching projections, because they provide complete assurance that the terminals will be retained in their operative, wire-engaging positions, it being noted that the latching projections do not operate until the terminals have been fully moved inwardly, thus assuring against the possibility that a careless worker might fail to force the tongues inwardly to their full extent and might thus produce a poor electrical connection.

While particular embodiments of this invention have been shown in the drawings and detailed above, it will be apparent, that changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. In a lampholder of the type intended for connection to at least two insulated wire conductors and comprising an electrically insulating body having at least two wireways for receiving the respective conductors, and means on the body for supportably engaging and making the electrical contact with an electric lamp, the improvement comprising:

(a) connector means of the insulation-displacing type, in the form of elongated members formed of a flat electrically conductive metal material, mounted upon the body adjacent the respective wireways and disposed in electrical contact with said lamp-engaging means, said connector means being adapted for displacing the insulation of the wire conductors to provide an electrical connection between the lamp-engaging means and the respective connectors and being mounted upon the body for swinging movement between retracted positions in which they clear their associated wireways to permit insertion of the conductors therein, and insulation-displacing positions in which they extend into the wireways and displace the insulation of said conductors to effect an electrical connection between the conductors and the respective connector means; and (b) means restraining the connector means against retrograde movement from the insulation-displacing to the retracted positions thereof, comprising, for each connector means, at least one resiliently yieldable latch element on the body releasably engaging its associated connector means in response to swinging movement of the connector means to its insulation-displacing position.

2. In a lampholder the improvement of claim 1 wherein the latch elements are formed as teeth having cam surfaces disposed in the path of swinging movement of said members and adapted to be engaged by the members on swinging movement of the members to their insulation-displacing positions, whereby to cammingly bias the teeth out of the path of said members, said teeth being resiliently biased into engagement with said members after passage of the members beyond the teeth, for holding the members against retrograde movement from their insulation-displacing positions.

3. In a lampholder the improvement of claim 2 wherein said members have proximal and distal ends, the proximal ends being anchored upon the body against movement and the distal ends being swingable between said retracted and insulation-displacing positions of the connector means, said distal ends being slotted to receive their associated conductors, the slots of the distal ends having opposed walls adapted for displacing the insulation of the conductors and thereby making electrical contact between the members and the conductors.

4. In a lampholder the improvement of claim 3 wherein the body has guide slots opening upon the wireways and adapted to slidably guide the distal ends to their insulation-displacing positions.

5. In a lampholder the improvement of claim 4 wherein the wireways of the body are in parallel relation and open upon one end of the body, the body having side walls and said members being extended along the side walls of the body, said members when in their retracted positions being divergent in a direction toward the wireways and projecting laterally outwardly from the side walls of the body along which they extend, the distal ends, when moved to the insulation-displacing positions of the connector means, extending across the respective wireways with portions of the members disposed adjacent to distal ends thereof extending substantially in parallel relation adjacent said side walls of the body, the latch elements being integrally formed upon the body and being disposed to engage in back of said portions when said portions are disposed in substantially parallel relation to each other with the distal ends extending across the wireways in insulation-displacing relation to the wire conductors.

6. In a lampholder of the type intended for connection to at least two insulated wire conductors and comprising an electrically insulating body having at least two wireways for receiving the respective conductors, and having means on the body for supportably engaging and making electrical contact with an electric lamp, said lamp engaging means having at least two electrical lamp contacts, the improvement comprising;

(a) electrically conductive connector members mounted upon the body and normally extended laterally outwardly of the body, said members having distal ends formed with insulation-displacing means normally disposed clear of the respective wireways in the laterally outwardly disposed positions of said members, said members being movably inwardly from said positions to positions in which the insulation-displacing means of said distal ends of the members extend across the wireways for displacing the insulation of the wire conductors received in the wireways, thus to make electrical contact between the connector members and the respective wire conductors; and (b) switch means adapted for operation by a user, mounted in the body for movement between circuit-opening and circuit-closing positions, said switch means in the circuit-closing position thereof providing an electrical connection between the respective lamp contacts and the connector members when the connector members are in their inwardly moved, insulation-displacing positions.

7. In a lampholder the improvement of claim 6 wherein the wireways are formed in one end of the body and said lamp contacts are mounted upon the other end thereof, said switch means being mounted within the body intermediate said ends of the body.

8. In a lampholder the improvement of claim 7 wherein the switch means includes a rotor having a plurality of circumferentially spaced electrical contacts, said rotor being adapted for indexing by a user to at least one circuit-closing and one circuit-opening position, the switch means further including a plurality of leaf spring contacts mounted in the body for movement into and out of engagement with contacts of the rotor responsive to said indexing of the rotor by a user, at least one of said connector members being mounted in electrical engagement with one of said leaf spring contacts.

9. In a lampholder the improvement of claim 7 wherein the rotor is disposed within the body and there are at least two connector members, disposed in spaced relation upon the body, said connector members being formed with proximal ends engaged fixedly in the body, there being leaf spring contacts angularly spaced about the rotor, having proximal ends engaged against the proximal ends of the respective connector members and having distal ends spring biased into slidable contact with the rotor for movement into and out of engagement with the rotor contacts, said connector members being bent upon themselves adjacent the proximal ends thereof, to define intermediate portions diverging in a direction toward the wireways along opposite sides of the body, said intermediate portions merging into distal end portions of the connector members normally disposed clear of the respective wireways, said intermediate portions being movable laterally of the body to dispose the distal end portions of the connector members within the wireways in insulation-displacing relation to the conductors, said rotor, in selected, indexed positions thereof, being adapted to close and to open an electrical circuit between the wire conductors and the lamp contacts, through the connector members, the leaf spring contacts, and the rotor contacts.

10. In a lampholder of the type intended for connection to at least two insulated wire conductors and comprising an electrically insulating body having at least two wireways for receiving the respective conductors, and means on the body for supportably engaging and making electrical contact with an electric lamp, the improvement comprising:

(a) at least two connector members each of which includes a flat first end portion, the body having mounting slots slidably receiving the first end portion for anchoring of the first end portions in the body, at least one of the connector members being bent reversely upon itself adjacent the first end portion thereof and having an intermediate portion, said intermediate end portion merging into a distal end portion extending laterally inwardly toward the first end portion and formed with insulation-displacing means adapted for piercing the insulation of the conductor to provide an electrical contact between said one connector member and an associated wire conductor, said intermediate portion of said one connector member being adapted to be swung inwardly toward the body to shift the distal end portion thereof into insulation-displacing relationship to the associated wire conductor; and (b) means providing an electrical connection between the first end portions of the respective connector members and said lamp-engaging means.

11. In a lampholder the improvement of claim 10, further including a latch means on the body adapted for engaging at least said one connector member when said one connector member has been shifted to a position in which the distal end portion thereof is in insulation-displacing relation to a wire conductor.

12. In a lampholder the improvement of claim 11 wherein the latch means is in the form at least one abutment resiliently flexibly mounted upon the body in the path of swinging movement of the intermediate portion of said one connector member, said abutment being adapted to be biased out of said path by said one connector member during movement of its distal end portion into insulation-displacing relation to a wire conductor, and being adapted to be spring-biased into abutting relationship to said one conductor member when the distal end portion thereof has been fully moved into its insulation-displacing position.

13. In a lampholder the improvement of claim 12 wherein the abutment has a cam surface disposed obliquely to said path of movement of said one connector member, in position to be engaged by an edge of said one connector member, whereby to temporarily bias the abutment out of said path.

14. In a lampholder the improvement of claim 13 in which the abutment is integrally connected to the body.

15. In a lampholder the improvement of claim 13 wherein the abutment is disposed exteriorly of the body in position to provide a visible reference to a user in which the abutment, when spring biased into abutting relationship to said one connector member, indicates to the user that the distal end portion of said one connector member is fully moved to a conductor-insulation-displacing position in which electrical contact has been made between a conductor and said one connector member.

* * * * *